US006971552B2

(12) United States Patent
Meshberg

(10) Patent No.: US 6,971,552 B2
(45) Date of Patent: Dec. 6, 2005

(54) AEROSOL DISPENSER

(75) Inventor: Philip Meshberg, Palm Beach, FL (US)

(73) Assignee: Dispensing Patents International, LLC, Boynton Beach, FL (US)

( * ) Notice: Subject to any disclaimer, the term of this patent is extended or adjusted under 35 U.S.C. 154(b) by 47 days.

(21) Appl. No.: 10/754,615

(22) Filed: Jan. 12, 2004

(65) Prior Publication Data

US 2004/0140324 A1 Jul. 22, 2004

Related U.S. Application Data

(63) Continuation-in-part of application No. 09/933,011, filed on Aug. 21, 2001, now Pat. No. 6,691,896.

(51) Int. Cl.[7] ..... B67B 5/00
(52) U.S. Cl. ..... 222/153.13; 222/402.11; 222/558
(58) Field of Search ..... 222/153.13, 153.14, 222/402.11, 402.12, 556, 558

(56) References Cited

U.S. PATENT DOCUMENTS 3,074,601 A * 1/1963 Kuffer ..... 222/402.24
3,373,908 A * 3/1968 Crowell ..... 222/402.13
3,422,996 A 1/1969 Lipman
3,721,423 A * 3/1973 Shay ..... 251/100
3,749,286 A * 7/1973 Douglas ..... 222/153.11
3,848,778 A 11/1974 Meshberg
3,904,088 A * 9/1975 Milbourne, Sr. ..... 222/402.11
4,773,567 A 9/1988 Stoody
5,379,924 A 1/1995 Taylor
5,593,064 A 1/1997 Meshberg
6,302,302 B1 * 10/2001 Albisetti ..... 222/153.11

* cited by examiner

*Primary Examiner*—Michael Mar
*Assistant Examiner*—Melvin A. Cartagena
(74) *Attorney, Agent, or Firm*—Kenyon & Kenyon

(57) ABSTRACT

An attachment for an aerosol dispensing package includes an actuator having at least one cam and a mounting cap having an upstanding wall and at least one inner rim to engage the cam. The actuator includes a spray nozzle and a downwardly extending projection, in fluid communication with the spray nozzle, to sealingly engage an upwardly projecting stem of an aerosol valve when the actuator is in a dispensing position. The cam engages the inner rim to lower the actuator to the dispensing position and raise the actuator to the non-dispensing position. The upstanding wall at least partially surrounds the actuator, and includes a lateral opening adjacent to the spray nozzle when the actuator is in the non-dispensing position, and a spray opening adjacent to the spray nozzle when the actuator is in the dispensing position. A nozzle closure, having a projection fitting into the lateral opening and the spray nozzle, may be hingedly attached to the mounting cap. The nozzle closure projection may seal the spray nozzle when the actuator is in the non-dispensing position. Safety and tamper evident tabs may also be included.

28 Claims, 13 Drawing Sheets

AEROSOL DISPENSER

CLAIM FOR PRIORITY/CROSS REFERENCE TO RELATED APPLICATIONS

This non-provisional application is a continuation-in-part of U.S. patent application Ser. No. 09/933,011, filed on Aug. 21, 2001 now U.S. Pat. No. 6,691,896, incorporated herein by reference in its entirety. This non-provisional application is also related to U.S. patent application Ser. No. 10/635,527, filed on Aug. 7, 2003.

1. Technical Field

The present invention relates to containers, generally, and, more particularly, to an attachment for an aerosol dispensing package.

2. Background of the Invention

U.S. Pat. No. 5,593,064, the disclosure of which is hereby incorporated by reference in its entirety, discloses a promotional dispensing package which is easily shipped, filled and assembled is disclosed. The package includes a retaining opening into which a modular pump is snap-fit by inserting the modular pump through an open end of the package. The package also includes a upstanding wall, which provides a dispensing actuator locking and sealing mechanism, as well as a tamper-evident tab. The package and pump are assembled at a production site, and are thereafter shipped to a filling site with a bottom. The package is filled through the open bottom end, and then the bottom is sealingly affixed to the package. Accordingly, the device can be filled and finally assembled with a minimal number of steps, and is therefore particularly suited for quick-turnaround marketing.

Although the package includes a dispensing actuator locking and sealing mechanism, as well as a tamper-evident tab, it is not childproof. That is, it is relatively easy, by rotation, to unlock the actuator and dispense material. In some cases the package might be used, for example, for a breath freshener and spraying in the mouth expected. However, the package might also contain insect repellant, sun tan lotion, or another product which is toxic if ingested. Particularly in view of these multiple uses, a young child could pick up a dispenser containing a toxic material and ingest it. The danger in other types of containers such as medicine bottles and containers for household chemicals, that a child might open and ingest a harmful substance is well known.

A typical aerosol dispenser includes an aerosol container with a standard-dimension mounting cup (e.g., one-inch diameter), aerosol valve with stem and spray dispensing actuator, such as, for example, a simple spray button or a more complicated locking and sealing mechanism. Various manufacturing processes may introduce variations in the dimensions of these components, such as, for example, submersion of the filled aerosol dispenser in one, or more, hot water baths. Unfortunately, hot water baths typically increase the internal pressure of the product-propellant mixture, thereby affecting the dimensions of the mounting cup, aerosol valve and stem, and spray dispensing actuator. Aerosol valves are sensitive to actuation-direction displacements, and may release product-propellant mixture under disturbances as small as 1/1000 of an inch. Because of the deformations introduced during various manufacturing processes, and due to the actuation sensitivity, generally, of aerosol valves, unintentionally discharge of the product-propellant mixture may occur during subsequent transportation, handling, etc., of a typical aerosol dispenser.

SUMMARY OF THE INVENTION

An attachment for an aerosol dispensing package includes an actuator having at least one cam and a mounting cap having an upstanding wall and at least one inner rim to engage the cam. The actuator includes a spray nozzle and a downwardly extending projection, in fluid communication with the spray nozzle, to sealingly engage an upwardly projecting stem of an aerosol valve when the actuator is in a dispensing position. The cam engages the inner rim to lower the actuator to the dispensing position and raise the actuator to the non-dispensing position. The upstanding wall at least partially surrounds the actuator, and includes a lateral opening adjacent to the spray nozzle when the actuator is in the non-dispensing position, and a spray opening adjacent to the spray nozzle when the actuator is in the dispensing position. A nozzle closure, having a projection fitting into the lateral opening and the spray nozzle, may be hingedly attached to the mounting cap. The nozzle closure projection may seal the spray nozzle when the actuator is in the non-dispensing position. Safety and tamper evident tabs may also be included.

BRIEF DESCRIPTION OF THE DRAWINGS

FIG. 9A is a perspective view of an aerosol dispenser in a dispensing position, while

DETAILED DESCRIPTION

Figure 1:
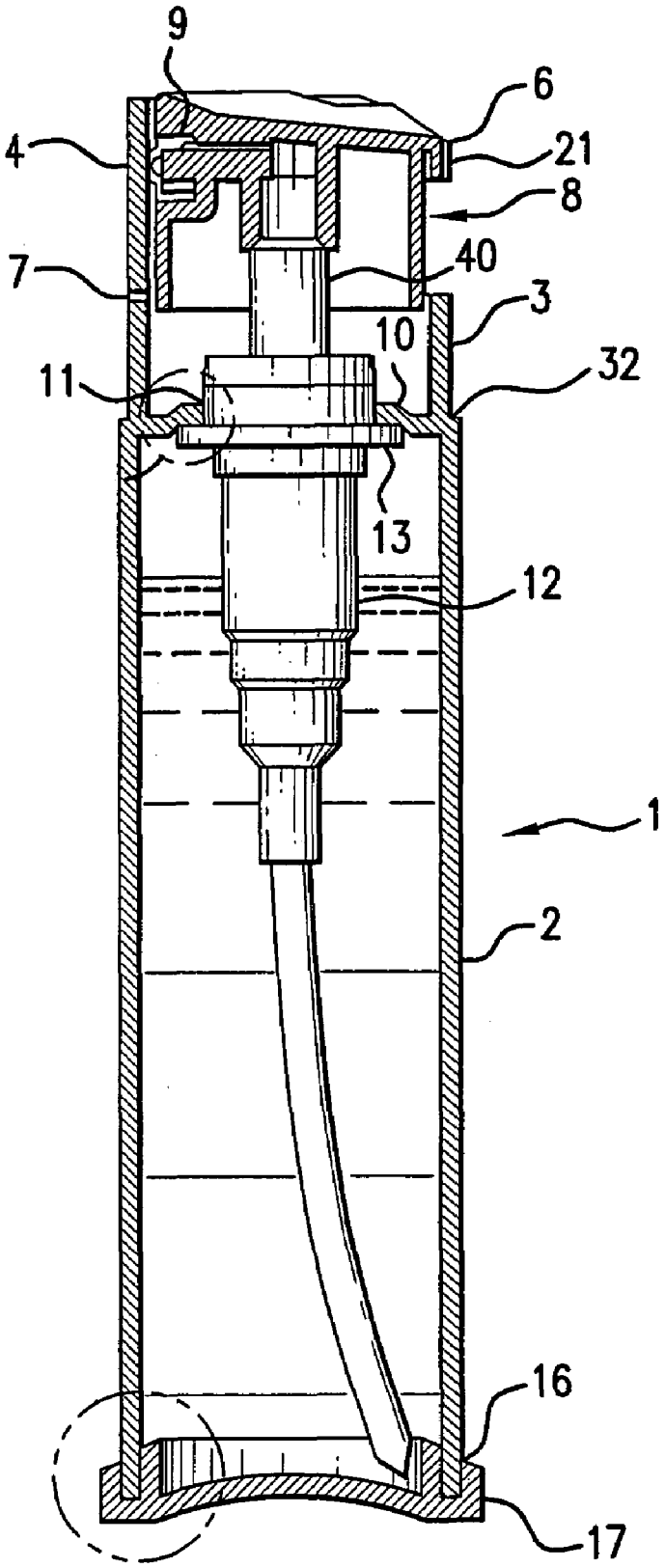
FIG. 1 is a cross-sectional view of a dispenser with which the present invention may be used.

An embodiment of a dispenser with which the present invention may be used is shown in cross-sectional view, in a sealed condition, in FIG. 1. The dispenser includes a package 1 which includes a container 2 and an upstanding wall 3 forming a sleeve. Upstanding wall 3 includes a tamper evident tab 4, connected to the upstanding wall 3 by a snap-away or tear-away joint 7. Joint 7 is originally molded to integrally connect tab 4 to upstanding wall 3, but is designed to be of sufficient thinness so that an end user can ultimately break the joint 7 so that the tab 4 can be removed from sleeve 3 to uncover nozzle 9 on actuator 6 when it is desired to first use the dispenser 1. Upstanding wall 3 can include a opening 8 intended to facilitate movement of an actuator nozzle 9 within the upstanding wall 3. Although shown as being vertically oriented in FIG. 1, tab 4 could also be oriented in a horizontal direction, with the joint 7 being disposed vertically at one end of the tab 4.

Container 2 and upstanding wall 3 are separated by a retaining wall 10 which includes a retaining opening 11 used to secure a pump 12 in the package 1. Pump 12 can be of any conventional design. Pump 12 includes a retention flange 13 for limiting the amount of inward movement of the pump 12 into the container 1 and for providing a surface for an energy director (not shown) to adhere during a process of sonic or ultrasonic welding. Alternatively, pump could include a retention groove which retains the pump 12 in the package 1 via a snap-fit engagement with retaining wall 10. Pump 12 is inserted into retaining opening 11 through the lower end 16 of container 2 or from the upper end including the upstanding wall 3, which is initially open. Pump 12 has a projecting stem 40 on the end of which actuator 6 is mounted.

Figure 2:
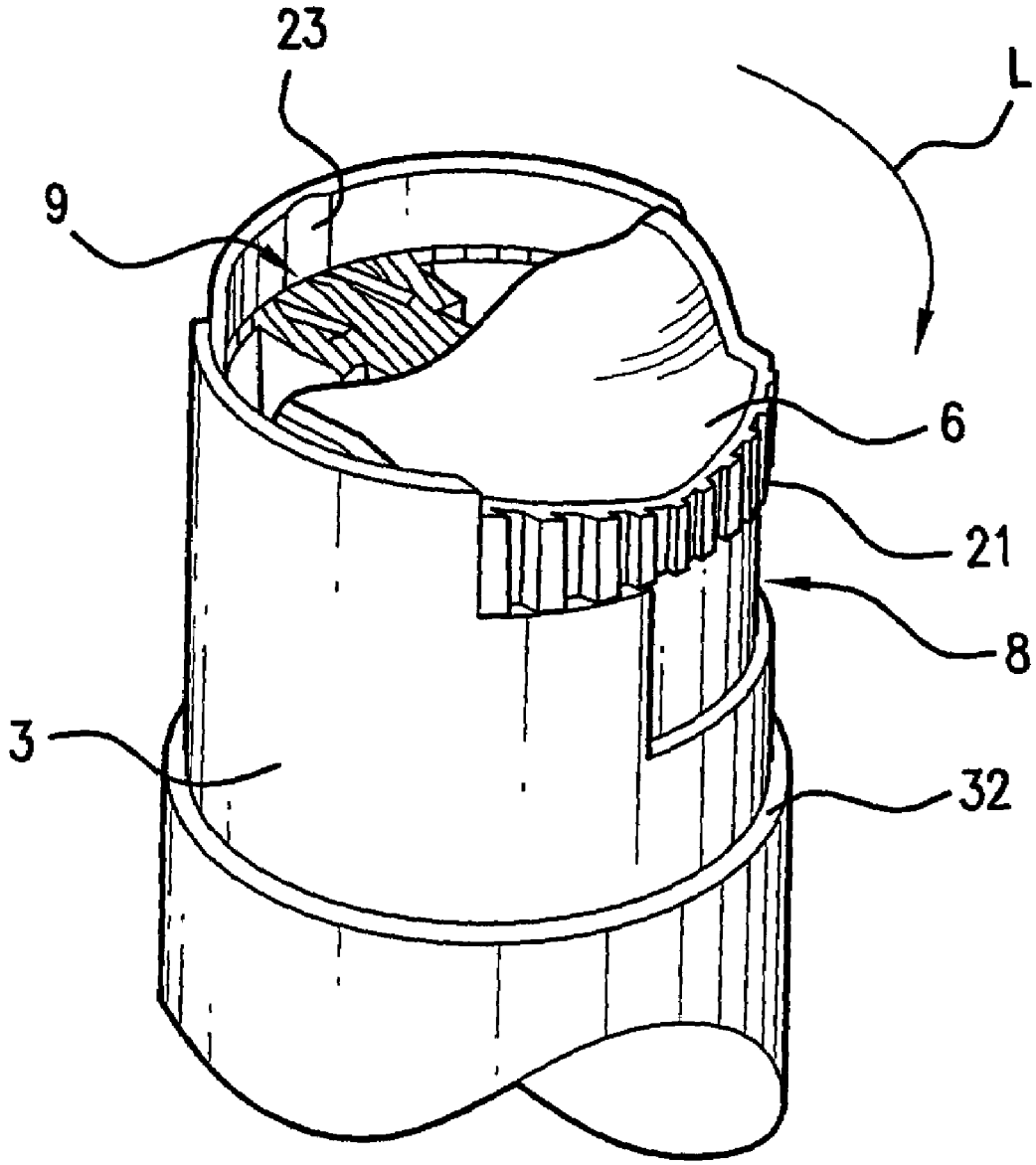
FIGS. 2–4 are perspective views of an actuator and locking mechanisms, wherein FIG. 4 includes a partial cross-sectional view.
Figure 4:
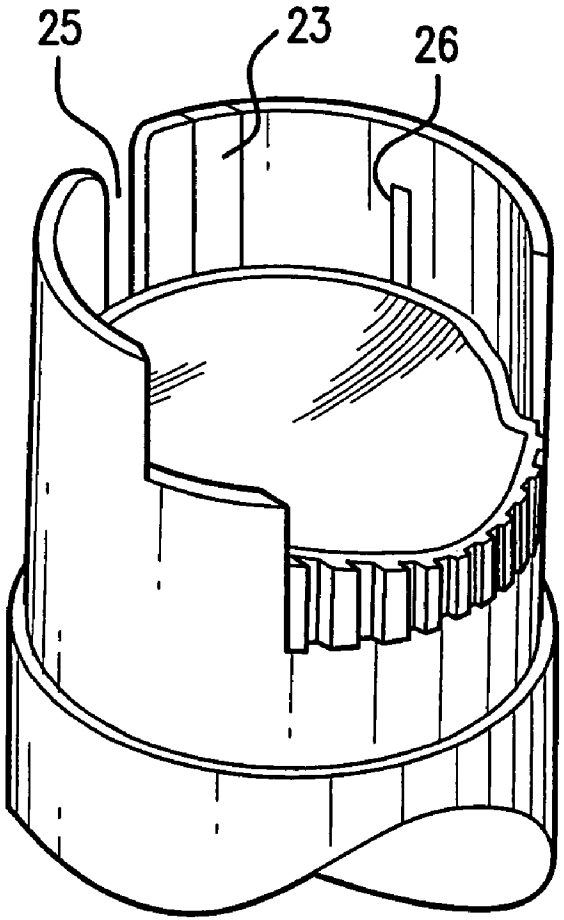
Figure 3:
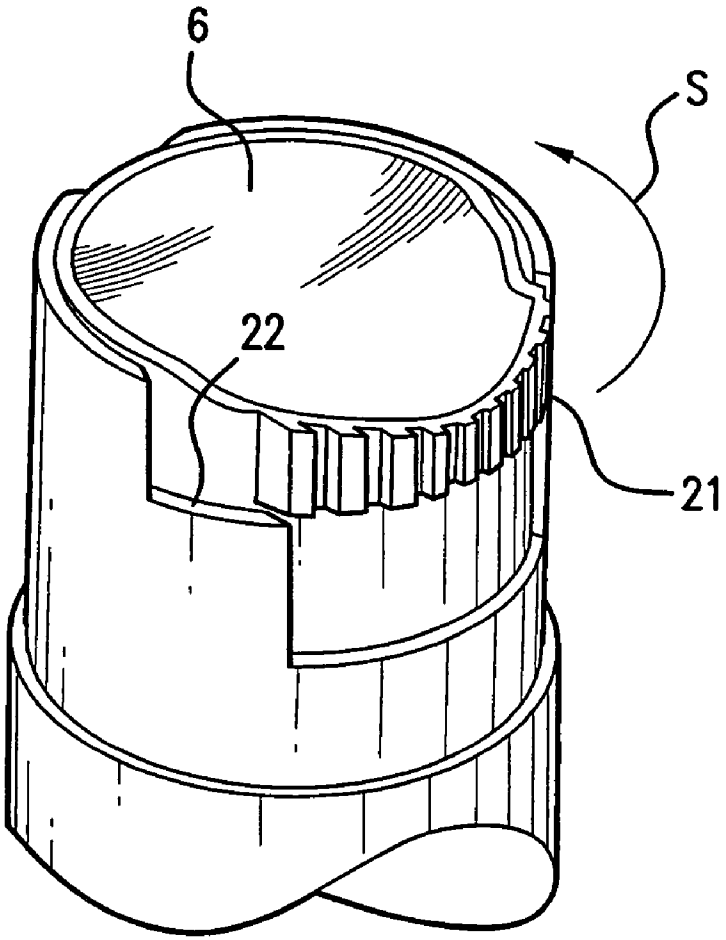

FIGS. 2–4 show the particular features of the actuator 6 of the dispenser, and the particular locking and retaining features of the upstanding wall 3. In FIG. 2, the forward of actuator 6 is shown in cross-sectional view, to show the manner in which the nozzle 9 is sealed in a non-dispensing position. Actuator 6 includes a projecting edge 21 which is used to rotate actuator 6 from a dispensing to a non-dispensing position, and which also acts to prevent downward movement of actuator 6 when actuator 6 is in a non-dispensing position. Upstanding wall 3 includes a limit stop 22 which prevents actuator 6 from moving downward—and thus dispensing material from pump 12—via engagement with limit stop 22 (See FIG. 2). The position of the actuator 6 shown in FIG. 2 is the position in which the actuator 6 is kept before the tab 4 is remove from upstanding wall 3. In this position, nozzle 9, which includes a slightly projecting tip, is snapped into a vertical groove 23. Groove 23 acts to retain nozzle 9 and actuator 6 in a non-dispensing position, and also seals the nozzle 9 against the incursion of air into the nozzle 9 orifice.

Rotating actuator 6 in the direction indicated by arrow S places the actuator 6 and nozzle 9 into a spraying or dispensing position. In the actuator as disclosed in U.S. Pat. No. 5,593,064, there was nothing to prevent this rotation. Thus, it could be done by a young child. In the dispensing position (shown in FIGS. 3 and 4) projecting edge 21 is in alignment with opening 8. In this position, nozzle 9 is aligned with opening 25 which is formed when tab 4 is removed. As seen by comparing FIGS. 3 and 4, projecting edge 21 travels within opening 8 upon downward actuation of actuator 6, allowing dispensing of material through nozzle 9 via pump 12. Rotating actuator 6 in the direction indicated by arrow L into a locking position, in which nozzle 9 is snapped into groove 23. Indication that nozzle 9 is properly in a non-dispensing position can be provided via a bead 26, which can coact with a bead on the outer circumferential surface of actuator 6, thereby providing an audible "snapping" sound when the beads slide over one another.

Figure 5:
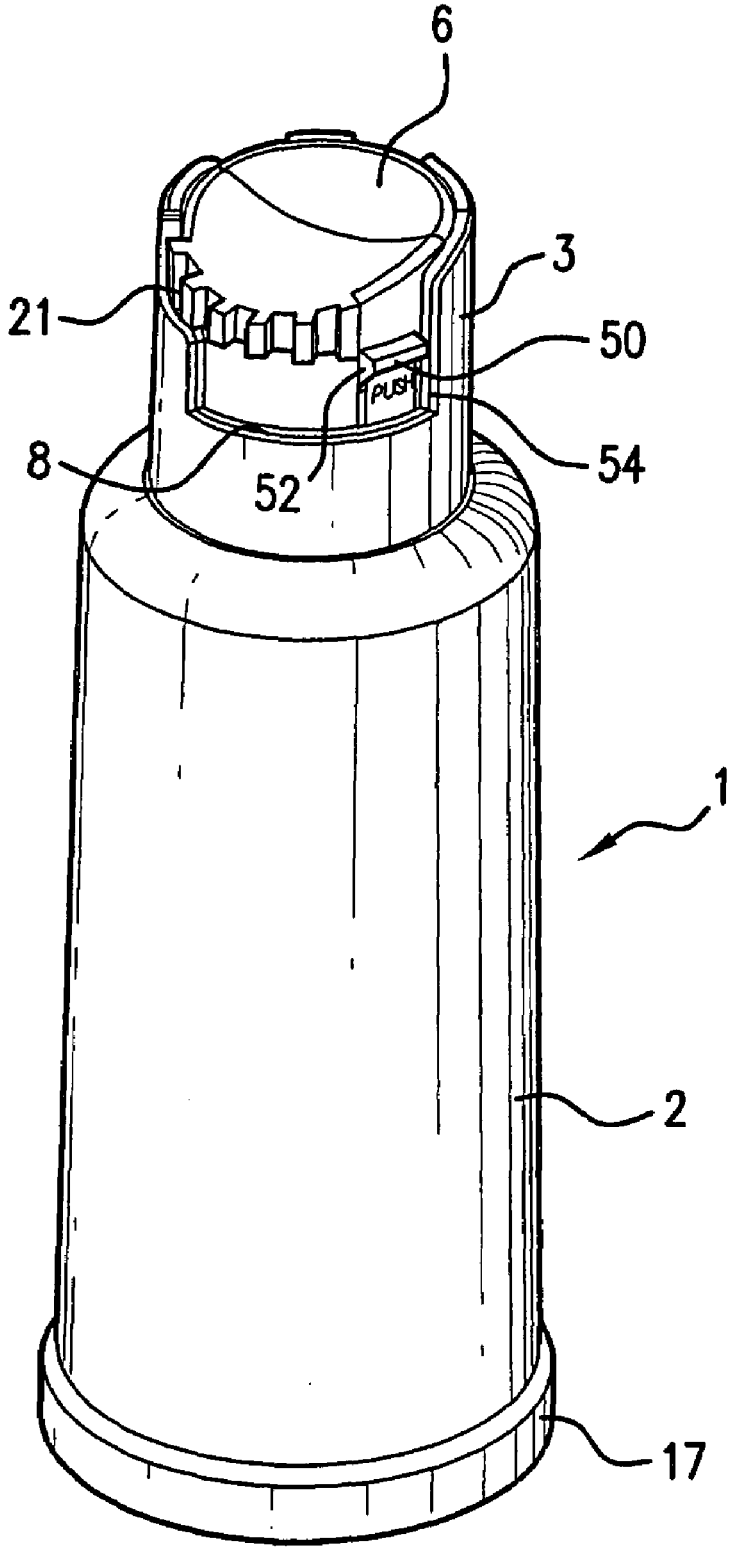
FIG. 5 is a rear perspective view of the dispenser with the safety tab of the present invention installed.

FIG. 5 is a rear perspective view of the package 1 of FIG. 1 in which the safety lock of the present invention is incorporated. Visible is the actuator 6 in sleeve 3. As noted above, the actuator must be rotated to align projecting edge 21 with opening 8. However, in accordance with the present invention, a safety tab 50 is formed in actuator 6 and has a projecting lip 52 which abuts a vertical wall 54 of opening 8 and prevents rotation. The tab 50 is hinged at its base and biased outwardly. To carry out rotation, one must push in on the tab 50 until the lip 52 clears the wall 54, while at the same time rotating the actuator. This is a two handed operation which is difficult for a small child to perform.

Figure 6:
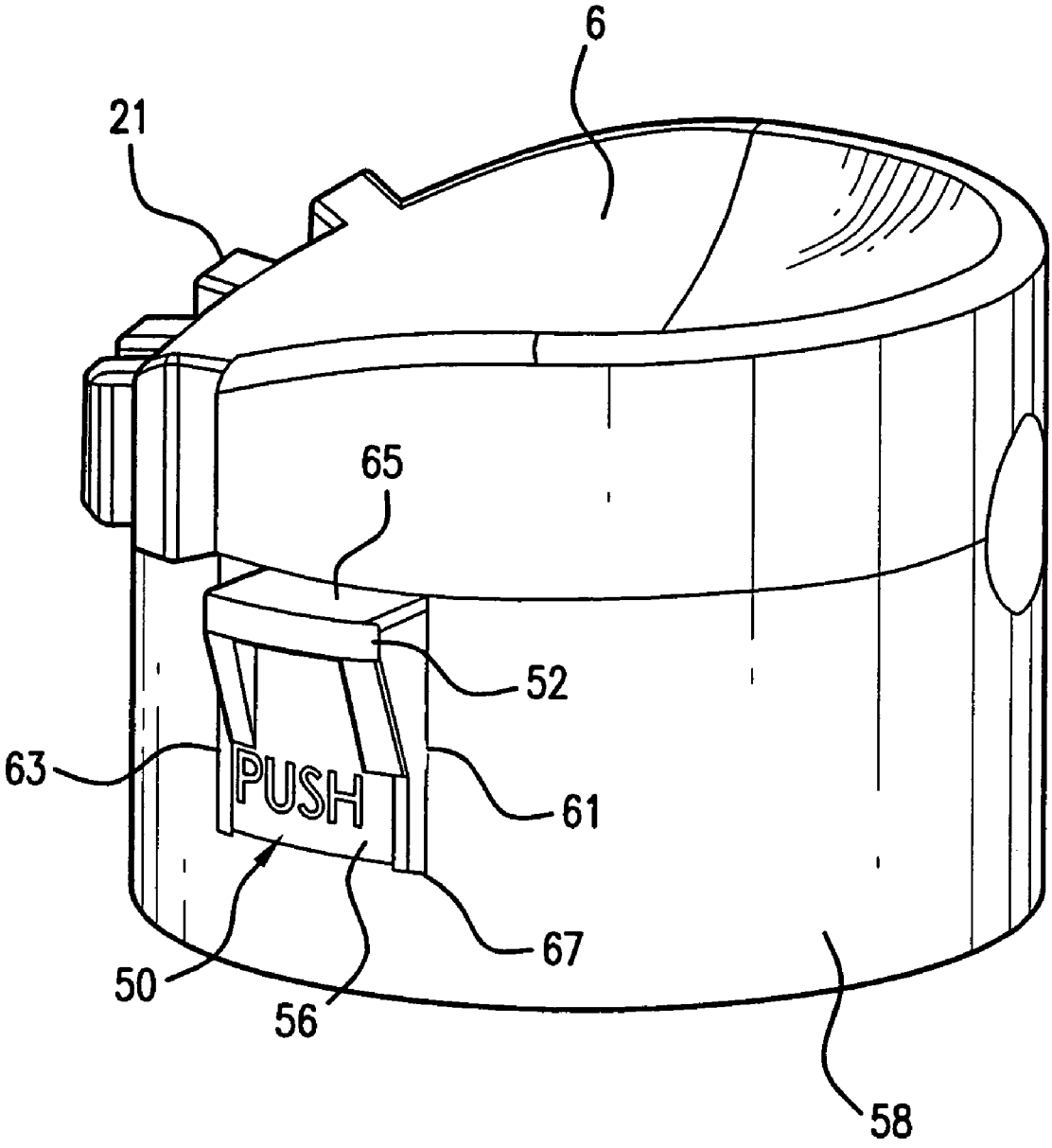
FIG. 6 is a perspective view of the actuator of the dispenser with the safety tab of the present invention.

FIG. 6 is a perspective view of actuator 6. In the illustrated embodiment, the tab 50 is molded in the wall 58 of the actuator 6. The base 56 of tab 50 is just a of wall 58. At the upper end of tab 50, the projecting lip 52 is formed. Vertical slits 61 and 63 and horizontal slit 65, extending through wall 58, separate tab 50 from the rest of the wall 58. Thus, by pushing in on the projecting lip 52, it can be forced to rotate about its base 67 which acts as a hinge. The fact that is an integral part of wall 58 insures that the projecting lip is biased outwardly. Although this is a simple way to form the biased hinged tab, other arrangement with different types of hinges and different forms of biasing may equally well be used.

The method of using the illustrated embodiment is as follows. The container 2 is molded as an integral unit with upstanding wall 3 and retaining wall 10. Container 2 is inverted, and may be inserted into a holding or restraining mechanism which interacts with shoulder 32 to restrain container 2 in an inverted position. Next, pump 12 is inserted into either the open end of lower end 16 or upper end including upstanding wall 3, so that the upper of pump 12 fits through retaining opening 11 until flange 13 abuts retaining wall 10. Actuator 6, with tab 50 formed therein, can then be inserted onto the outlet stem 40 of pump 12.

The container 2 thus assembled is shipped together with bottom 17 (See, e.g., FIG. 1) in an unassembled condition to a filling and assembly location where it may be filled and labeled and shipped to an end user.

Upon receiving package 1, the customer breaks off tab 4, and then when dispensing is desired, rotates actuator 6 to the position shown in FIG. 5. To do this, as noted above, it is necessary to first press in on tab 50 until it clears wall 54 of opening 8, while at the same carrying out a rotation. Downward actuation of actuator 6 dispenses liquid product from package 1, through nozzle 9. Upon completion of actuation, the actuator 6 is rotated back to the position shown in FIG. 5 and tab 50 snaps back in the position where the actuator can not be rotated without pushing it in again.

Figure 7:
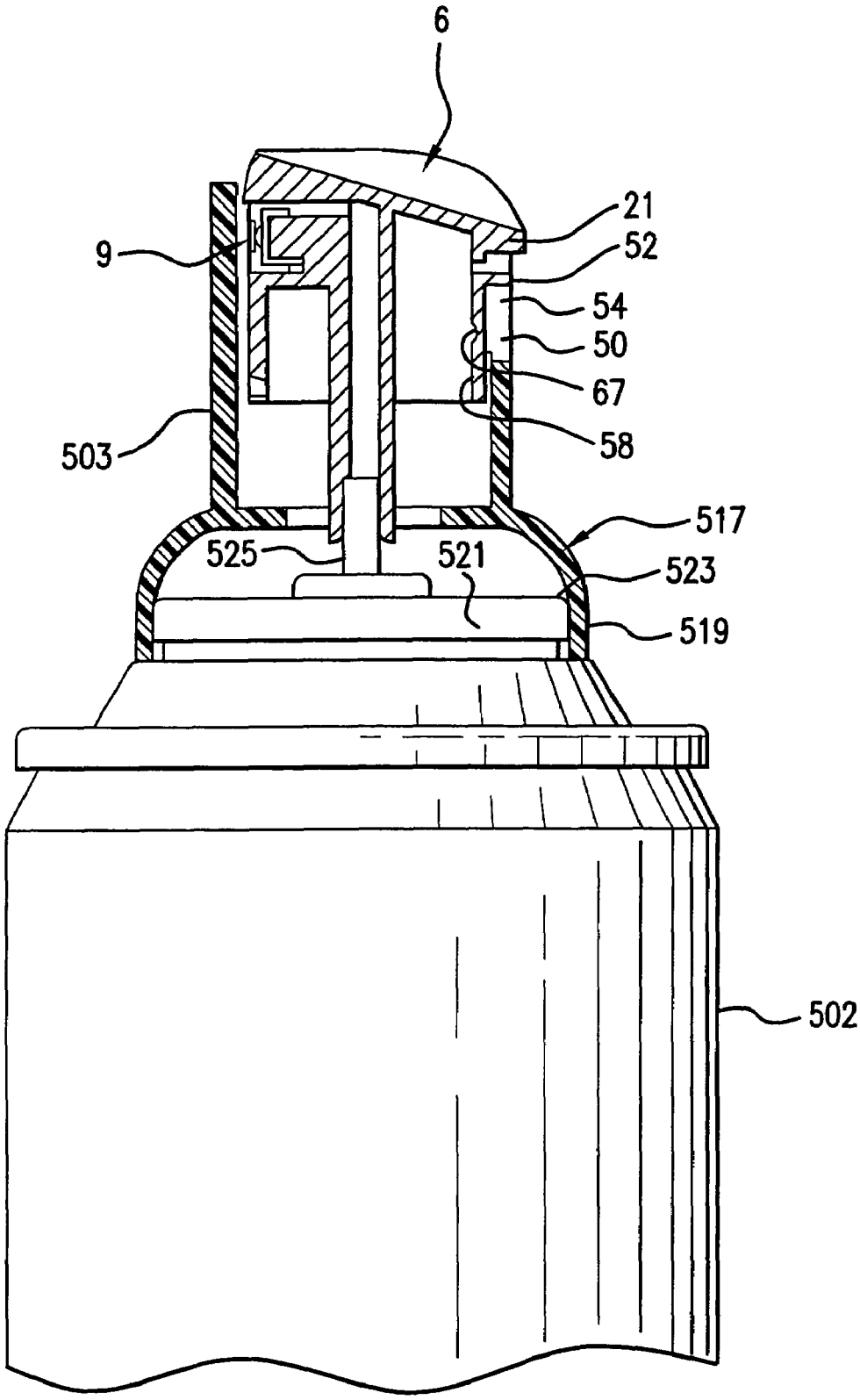
FIG. 7 is a cross-sectional view of an embodiment of the safety device of the present invention mounted on an aerosol dispenser.

The embodiment of FIG. 1 is directed to a pump. However, the actuators with spray nozzles described herein may also be used with aerosol valves. A specific example of an embodiment of the present invention used with an aerosol valve is shown in FIG. 7, which shows an aerosol container 502 with a mounting cap 517 which includes an embodiment of the nozzle closure of the present invention of the general nature shown in FIGS. 2–6. Container 502 may include, at its upper end, a mounting cup 521 having a beaded rim 523 extending around its entire circumference. The mounting cap 517 shown in FIG. 7 may include a cylindrical skirt 519 which engages beaded rim 523, with a press fit, attaching mounting cap 517, and with its upstanding wall 503, to container 502. The mounting cap can also or alternatively be designed with a bead on its end, which will allow it to snap over the beaded rim 523. Wall 503 is constructed in a manner similar to wall or sleeve 3 of the previously explained embodiments. In conventional fashion, this is part of mounting cup 521. Mounting cup 521 contains an aerosol valve and has as its purpose mounting the aerosol valve to the top of container 502. A stem 525 for actuating the aerosol valve projects from the aerosol valve in conventional fashion. Downwardly extending projection 599 of actuator 6 is pressed onto the projecting stem to permit actuating the valve and dispensing material through nozzle 9.

The construction and operation of safety lock of the present invention is as explained above. The cross-sectional view of FIG. 7 shows tab 50 with projecting lip 52 abutting against wall 54. Base 67 of the tab 50 is a thinner section of the wall to act as a hinge. In the position shown, the dispensing outlet or nozzle 9 of the actuator 6 is behind wall 3 and dispensing is not possible. It is necessary to rotate actuator 6 to a position where nozzle 9 is aligned with an opening (not shown) such as the opening 25 of FIG. 4. In order to do this, the tab 50 must be pushed in, clear of the wall 54, and the actuator rotated at the same time, as described above, a difficult task for a small child.

In the embodiment of FIG. 1, the upstanding wall 3 is integral with the container. It will be recognized that just as the arrangement of the present invention can be added to a conventional aerosol dispenser, as illustrated in FIG. 7, it can also be added to an existing pump dispenser but providing a mounting cap which engages the body of the pump dispenser. These and other modifications can be made without departing from the spirit of the invention.

Furthermore, embodiments of the present invention has been described in the context of a liquid dispensing package. However, it is equally applicable to other types of packages, where a safety feature is need. Examples, include medicine bottles, containers for household chemical etc. All that is required is a sleeve attached to the container and within which a part (the actuator in the illustrated embodiment) is rotated place the container in a position where dispensing can take place. In the illustrated embodiment the actuator is pressed to spray a material. If the container contained liquid or powder to be poured, the rotation would result in removal or partial removal of a cap. The sleeve has a recess with a wall against which an outwardly biased hinged tab on the first part abuts and prevents rotation, unless the tab is pushed in to clear the wall, while at the same time rotating the first part into an open or dispensing position. These and other modifications can be made without departing from the spirit of the invention which is intended to be limited solely by the appended claims.

Figure 8A:
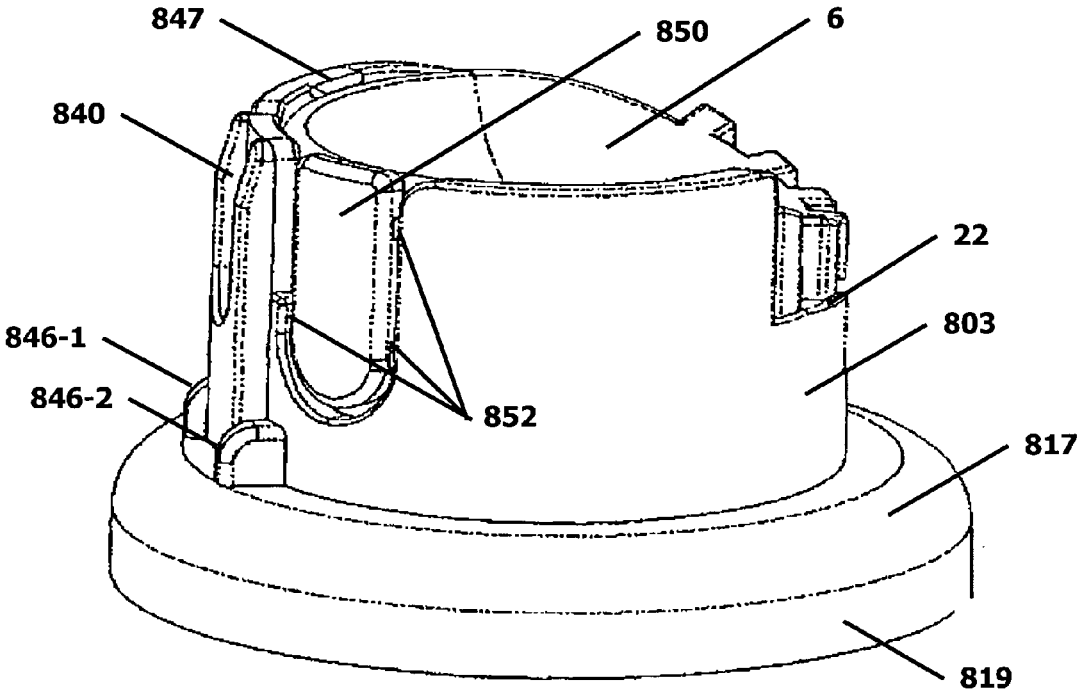
FIGS. 8A and 8B are perspective and cross-sectional views, respectively, of an aerosol dispenser in a non-dispensing position, in accordance with an embodiment of the present invention.
Figure 8B:
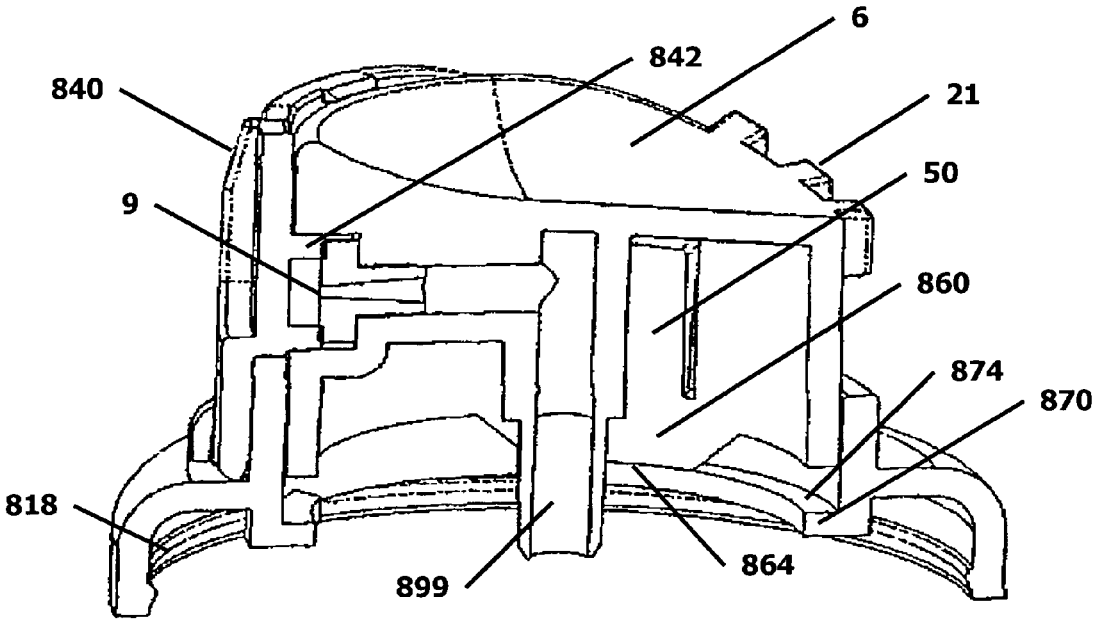
Figure 9A:
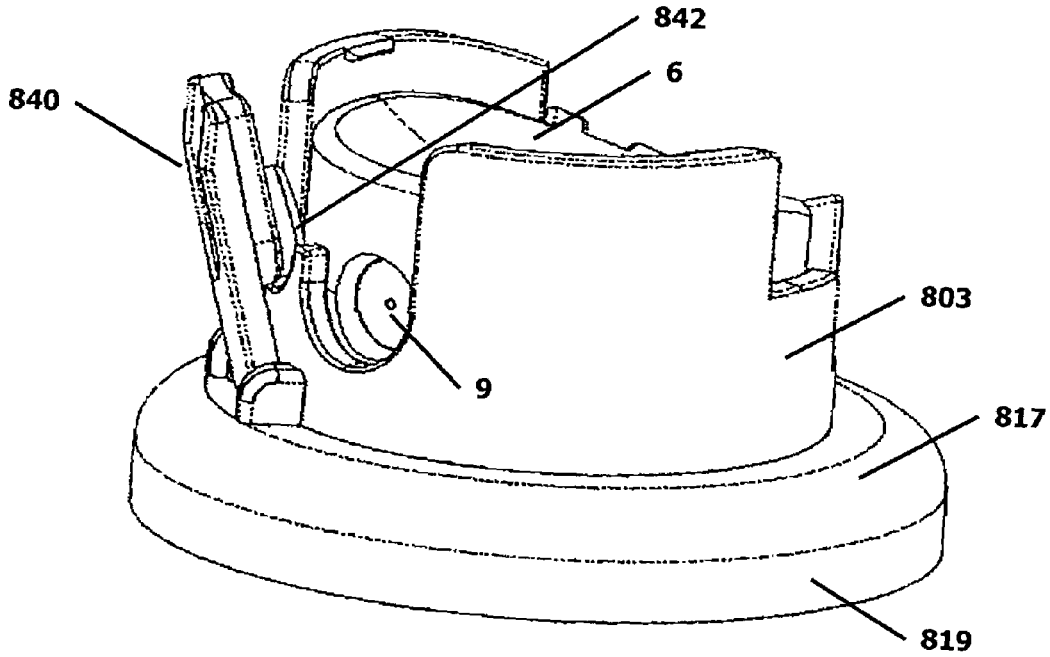
Figure 9B:
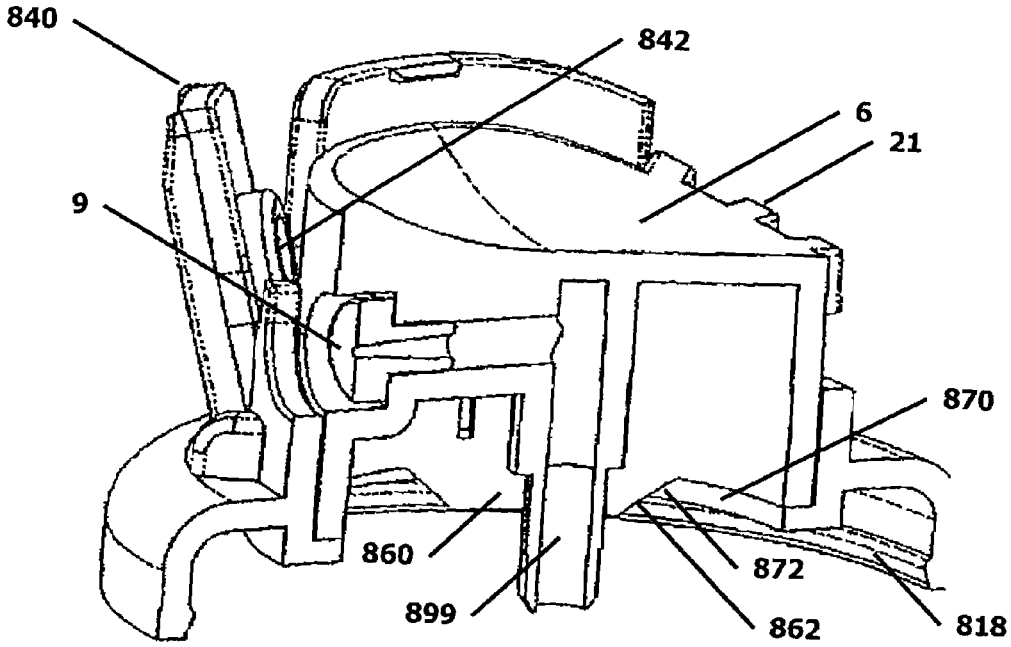
FIGS. 9B and 9C are cross-sectional views of an aerosol dispenser in a dispensing position, in accordance with embodiments of the present invention.
Figure 9C:
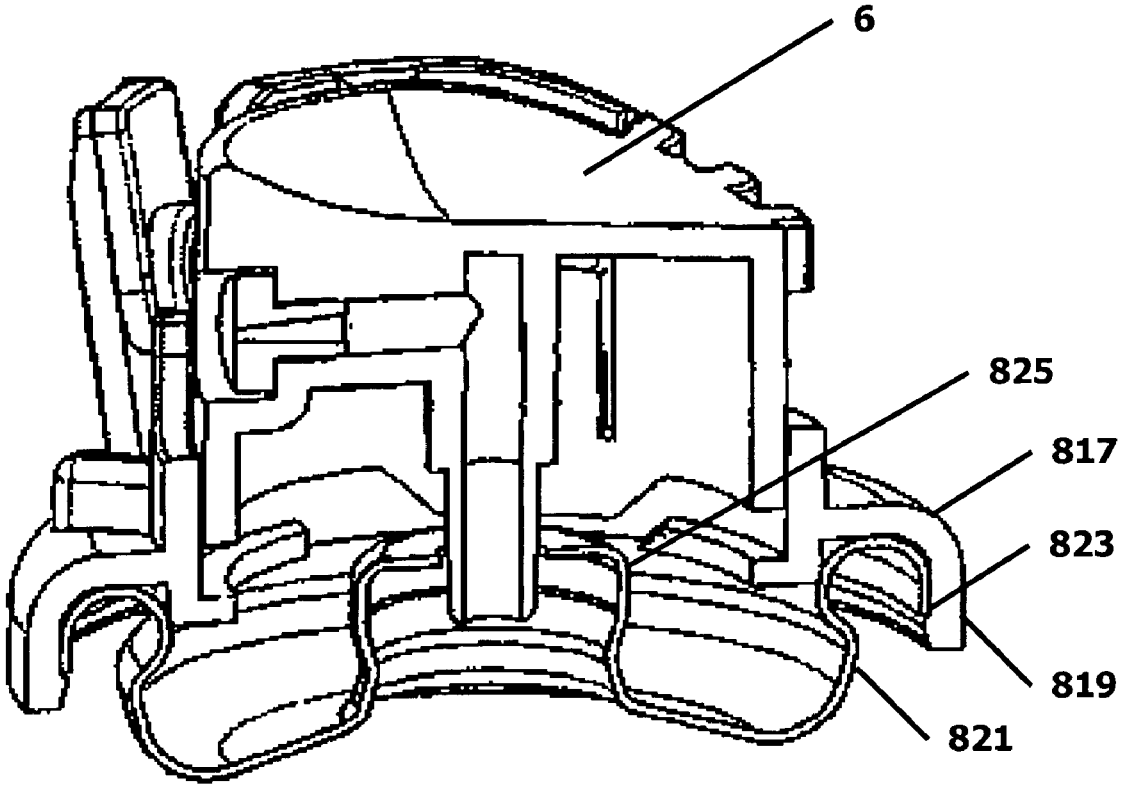

FIGS. 8A and 8B are perspective and cross-sectional views, respectively, of an aerosol dispenser in a non-dispensing position, FIG. 9A is a perspective view of an aerosol dispenser in a dispensing position and FIGS. 9B and 9C are cross-sectional views of an aerosol dispenser in a dispensing position, in accordance with embodiments of the present invention.

Mounting cap 817 may include upstanding wall 803, cylindrical skirt 819 and inner rim 870. Upstanding wall 803 may be constructed, for example, in a manner similar to wall 503 of the previously described embodiment. Upstanding wall 803 may include lateral opening 830, spray opening 831 and anterior opening 834, as depicted, generally, in FIG. 10. In one embodiment, lateral opening 830 and spray opening 831 may form one contiguous opening, while in another embodiment, lateral opening 830 and spray opening 831 may form independent, non-contiguous openings.

Cylindrical skirt 819 may engage an aerosol container's mounting cup, such as, for example, mounting cup 821 (the aerosol container is not shown in FIG. 9C for clarity). In one embodiment, mounting cap 817 may be press fit onto mounting cup 821, while in another embodiment, mounting cap 817 may be snap fit onto mounting cup 821. In the latter embodiment, mounting cap 817 may include bead 818 to engage beaded rim 823 extending around the entire circumference of the aerosol container. In conventional fashion, beaded rim 823 may be part of mounting cup 821. Mounting cup 821 may also include an aerosol valve with an upwardly-projecting stem 825. The upwardly-projecting aerosol valve stem may terminate in either a female fitting, as depicted in FIG. 9C, or a male fitting.

Figure 11:
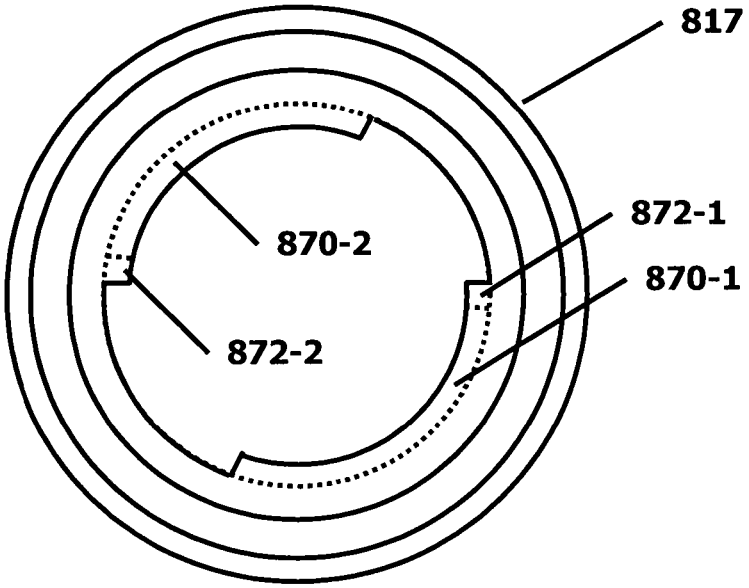
FIG. 11 is a bottom view of a mounting cap, in accordance with an embodiment of the present invention.
Figure 12:
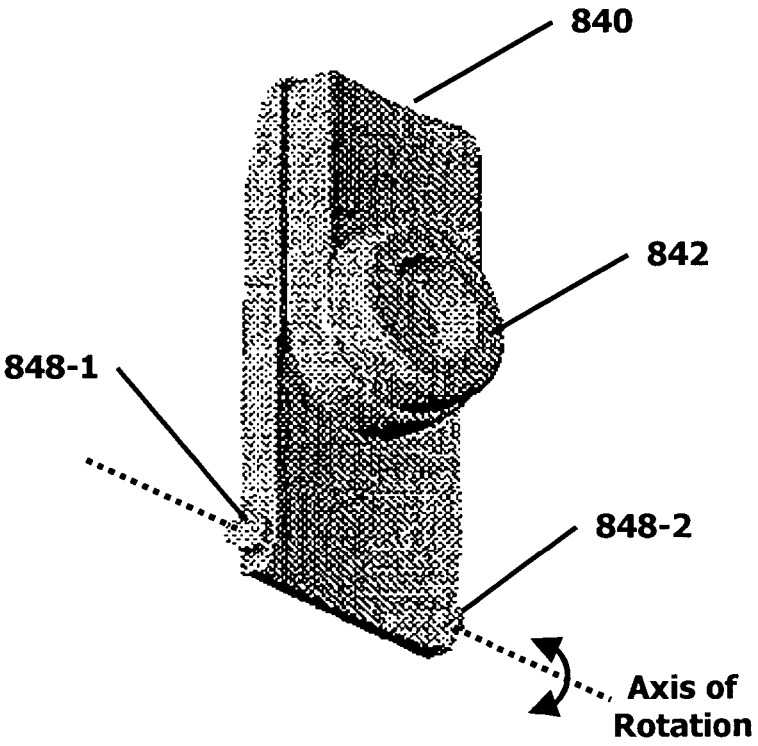
FIG. 12 is a perspective view of a nozzle closure, in accordance with an embodiment of the present invention.

Inner rim 870 may extend around a portion of the inner diameter of the mounting cap 817. Inner rim 870 may include inner rim leading edge 872 and inner rim upper surface 874. In one embodiment, mounting cap 817 may include two inner rims, such as, for example, inner rim 870-1 and inner rim 870-2 as depicted, generally, in FIG. 11.

Actuator 6 may be partially or completely surrounded by upstanding wall 803, and may include spray nozzle 9, in fluid communication with downwardly extending projection 899, and cam 860. Generally, spray nozzle 9 may be adjacent to lateral opening 830 when actuator 6 is in the non-dispensing position, and adjacent to spray opening 831 when actuator 6 is in the dispensing position.

Figure 13A:
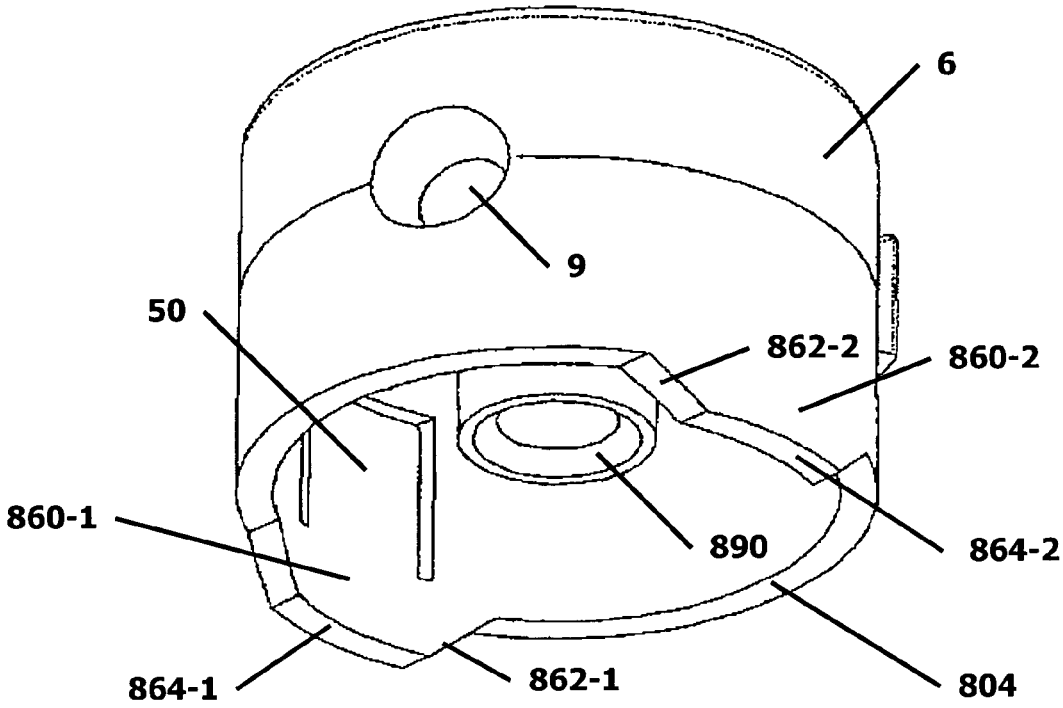
FIGS. 13A and 13B are perspective views of an actuator for use with a male aerosol valve stem and a female aerosol valve stem, respectively, in accordance with an embodiment of the present invention.
Figure 13B:
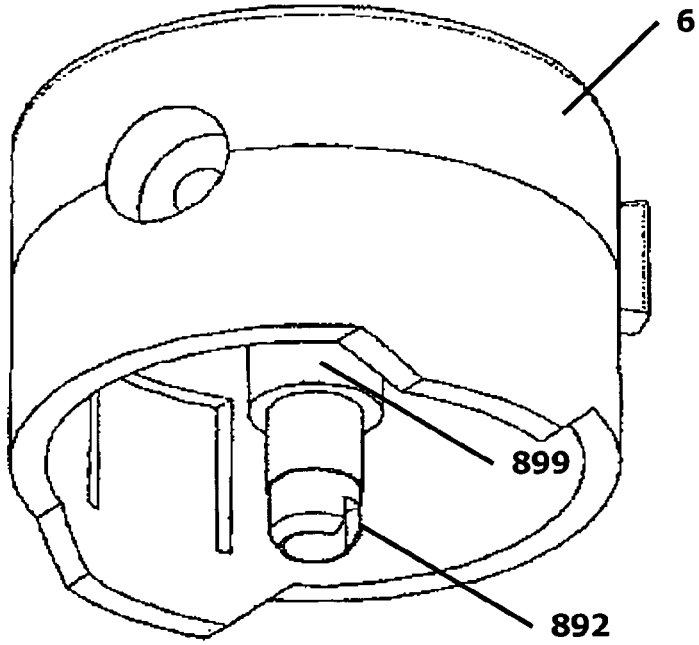

When actuator 6 is in the non-dispensing position, cam 860 may engage inner rim 870 to prevent actuator 6 from moving downward. For example, cam lower surface 864 may partially, or completely, abut inner rim upper surface 874 in the non-dispensing position. In one embodiment, actuator 6 may include cam 860-1 and cam 860-2 to engage inner rim 870-1 and inner rim 870-2, respectively, as depicted, generally, in FIGS. 11, 13A and 13B. In this embodiment, cam lower surface 864-1 may partially, or completely, abut inner rim upper surface 874-1; similarly, cam lower surface 864-2 may partially, or completely, abut inner rim upper surface 874-2. Cam 860-1 and cam 860-2 may extend around a portion of the lower circumference of actuator 6, and, similarly, inner rim 870-1 and 870-2 may extend around a complementary portion of the inner diameter of mounting cap 817.

Figure 14A:
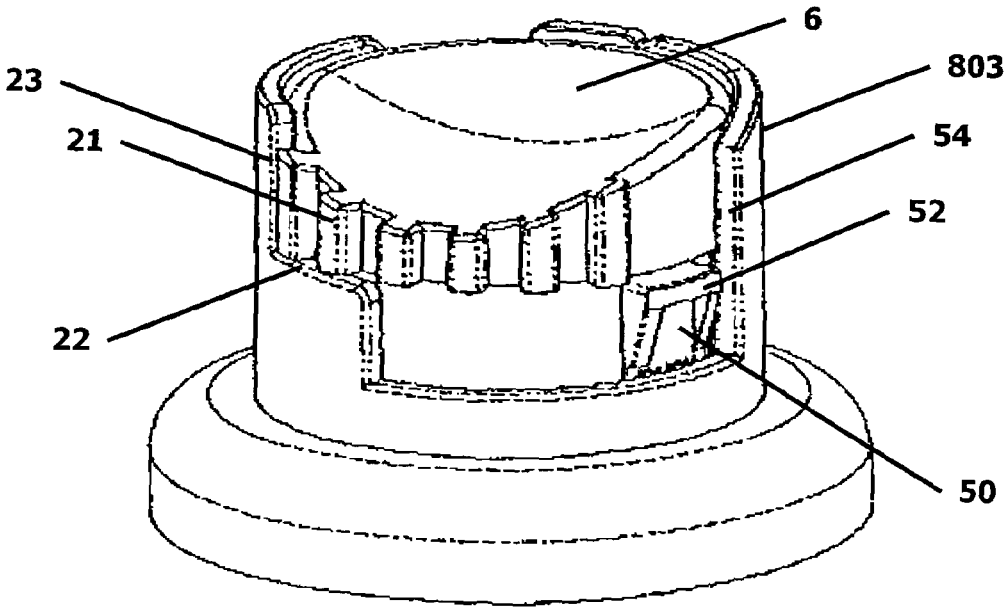
FIGS. 14A and 14B are perspective views of an aerosol dispenser in non-dispensing position and a dispensing position, respectively, in accordance with an embodiment of the present invention.

Actuator 6 may also include projecting edge 21, such as, for example, a knurled edge, a series of projecting ridges, an overhanging lip, etc., to provide a gripping surface to rotate actuator 6 from a non-dispensing position to a dispensing position. In one embodiment, actuator 6 may include safety tab 50, as described, generally, with reference to the embodiments depicted in FIGS. 5–7. For example, FIG. 14A depicts projecting lip 52, of safety tab 50, abutting vertical wall 54 of upstanding wall 803.

When actuator 6 is in the dispensing position, downwardly extending projection 899 may engage the upwardly-projecting stem of the mounting cup's aerosol valve. For male aerosol valve stems, downwardly extending projection 899 may include a female fitting (e.g., female fitting 890 of FIG. 13A), and, conversely, for female aerosol valve stems, downwardly extending projection 899 may include a male fitting (e.g., male fitting 892 of FIG. 13B). When actuator 6 is in the non-dispensing position, however, downwardly extending projection 899 may be partially, or completely, disengaged from the upwardly-projecting aerosol valve stem, due to the interaction of cam 860 with inner rim 870, as described in more detail below.

In an embodiment, nozzle closure 840 may be hingedly attached to mounting cap 817, and may include projection 842, fitting into lateral opening 830 and spray nozzle 9, to seal spray nozzle 9 when actuator 6 is in the non-dispensing position. Advantageously, insertion of projection 842, through lateral opening 830, into spray nozzle 9 may create a local high pressure region (i.e., greater than atmospheric pressure) which may force excess material from the orifice of spray nozzle 9. Similarly, removal of projection 842 from spray nozzle 9 may create a local low pressure region (i.e., lower than atmospheric pressure) which may also facilitate removal of excess material from the orifice of spray nozzle 9. For example, dispensing spray paint from an aerosol container typically involves the accumulation of spray paint residue in, and around, the spray nozzle. The insertion of projection 842, through lateral opening 830, into spray nozzle 9 may create a local pressure region which forces excess paint away from spray nozzle 9. Moreover, the presence of projection 842 within spray nozzle 9 may also prevent seepage, clotting, etc.

In one embodiment, nozzle closure 840 may include hinge pin 848-1 and hinge pin 848-2 projecting laterally into hinge support 846-1 and hinge support 846-2, respectively, to permit rotation of nozzle closure 840 about a horizontal axis defined thereby, as depicted, generally, in FIGS. 8A, 9A, 11 and 12. Any number of well-known hinge support mechanisms may be employed. For example, hinge support 846 may include a circular recess (not shown for clarity) to receive hinge pin 848. In this embodiment, nozzle closure 840 may be snapped into position between hinge support 846-1 and hinge support 846-2, opposite lateral opening 830. Alternatively, hinge support 846 may include a vertical slot (also not shown for clarity) extending from the upper edge to the middle section of hinge support 846. In this embodiment, nozzle closure 840 may be slid vertically into position, and hinge pin 848 may optionally engaging a circular recess, locking detent, etc., near the bottom of the vertical slot. A vertical, rather than horizontal, hinge arrangement may also be employed.

In another embodiment, upstanding wall 803 may include tamper evident tab 850 disposed within spray opening 831 and connected to upstanding wall 803 by one, or more, break-away connectors 852. Tamper evident tab 850 may prevent premature, or unauthorized, dispensing of spray through spray nozzle 9 when actuator 6 is in the dispensing position. In one embodiment, connector 852 may be originally molded to integrally connect tab 850 to upstanding wall 803, and may be designed to be of sufficient thickness to allow tab 850 to be removed from upstanding wall 803 just prior to a first use. In another embodiment, connector 852 may be integrally molded to form a contiguous joint extending partially, or completely, along the interface between tab 850 and upstanding wall 803. In this embodiment, connector 852 may also be designed to be of sufficient thickness to allow tab 850 to be removed from upstanding wall 803 just prior to a first use. Other well-methods may also be used to attached tab 850 to upstanding wall 803 in a break-away, or tear-away, manner. In this manner, unauthorized actuation of the dispensing device, e.g., tampering, may be suggested, or detected, by the removal of tamper evident tab 850.

Figure 10:
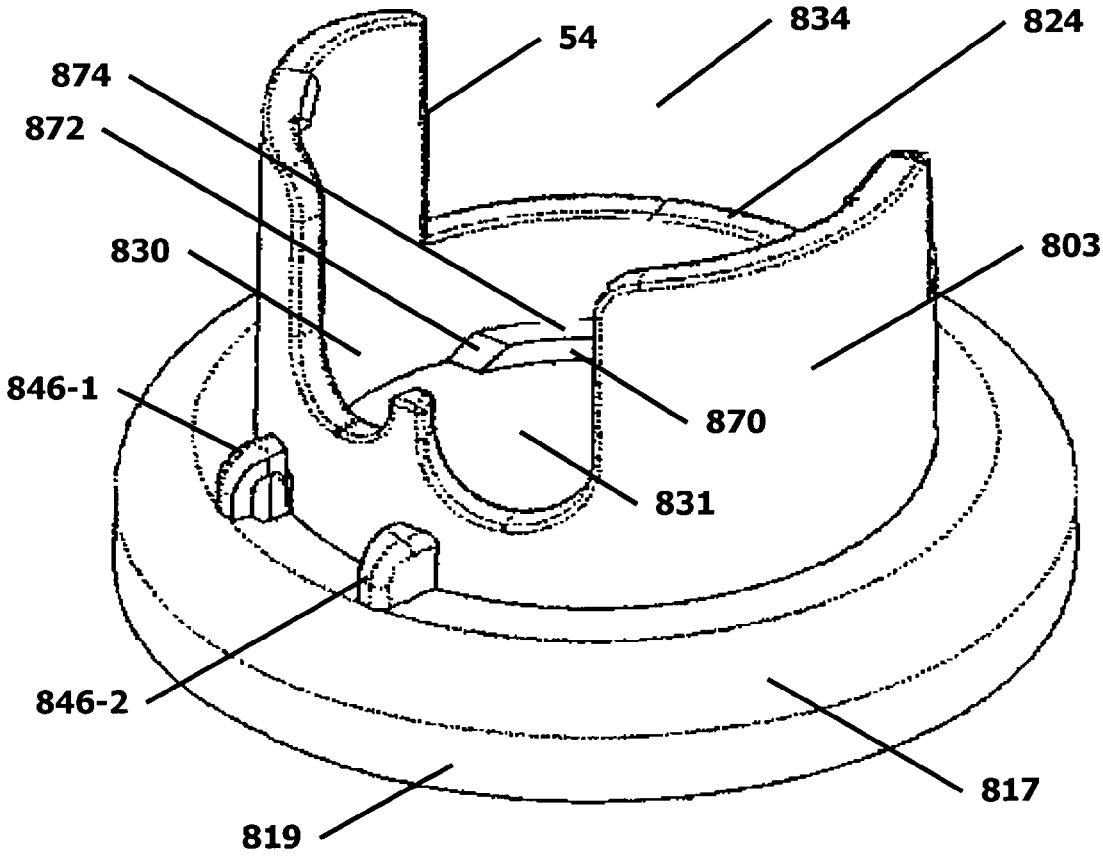
FIG. 10 is a perspective view of an upstanding wall and mounting cap arrangement, in accordance with an embodiment of the present invention.
Figure 14B:
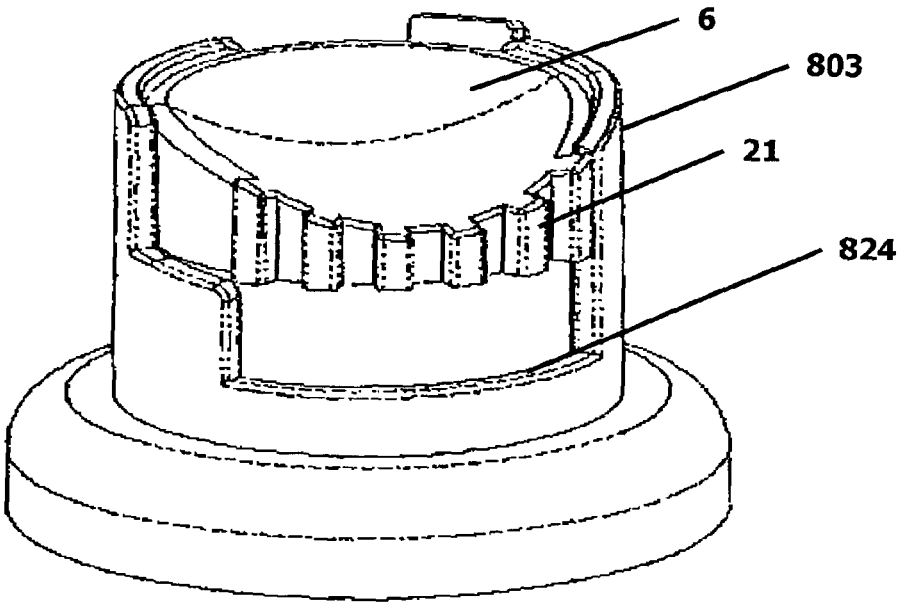

Anterior opening 834 may facilitate movement of actuator 6 within upstanding wall 803, as depicted in FIGS. 10, 14A and 14B, and in a manner similar to the embodiments depicted in FIGS. 2–7. Accordingly, when actuator 6 is in the non-dispensing position, projecting edge 21 may overlie and engage limit stop 22 to prevent actuator 6 from moving downward. In the dispensing position, projecting edge 21 may travel through anterior opening 834 as actuator 6 is depressed, until projecting edge 21 approaches limit stop 824. In one embodiment, projecting edge 21 may engage limit stop 824 to prevent further downward motion of actuator 6, while in another embodiment, projecting edge 21 may not engage limit stop 824. In the latter embodiment, lower surface 804 of actuator 6 arrests the downward motion of actuator 6 by engaging inner rim upper surface 874, as depicted within FIGS. 9B, 10 and 13A. In a further embodiment, both limit stop 824 and inner rim 870 simultaneously arrest the downward motion of actuator 6 by engaging projecting edge 21 and lower surface 804, respectively. Rotating actuator 6 in the direction indicated by arrow S of FIG. 3 places actuator 6 in the dispensing position, while rotating actuator 6 in the direction indicated by arrow L of FIG. 2 places actuator 6 in the non-dispensing position.

Operation of actuator 6 from the non-dispensing position to the dispensing position may be described as follows. When actuator 6 is in the non-dispensing position, in one embodiment, nozzle closure 840 is first moved from the closed position, in which projection 842 seals spray nozzle 9, to the open position, in which projection 842 is clear of spray nozzle 9 and lateral opening 830, thereby permitting the rotation of actuator 6. Nozzle closure 840 may be moved from the closed position to the open position, for example, by rotating about the hinge axis. Once projection 842 is clear of upstanding wall 803, actuator 6 may be rotated from the non-dispensing position to the dispensing position by gripping projecting edge 21 and rotating in the appropriate direction. In one embodiment, safety tab 50 is depressed at the same time as actuator 6 is rotated, so that projecting lip 52 may clear vertical wall 54 of upstanding wall 803. Once projecting edge 21 clears limit stop 22 of upstanding wall 803, actuator 6 is in the dispensing position and actuator 6 may be depressed as often as desired. As noted above, simultaneous rotation of actuator 6 and depression of safety tab 50 may be difficult for small children. In another embodiment, tamper evident tab 850 may be removed prior to rotating actuator 6 by breaking connector 852.

As actuator 6 is rotated from the non-dispensing position to the dispensing position, cam 860 rotates with respect to inner rim 870 until cam leading edge 862 contacts inner rim leading edge 872. Cam leading edge 862 may be inclined to form an angle with respect to the horizontal which may complement inner rim leading edge 872, also inclined to form an angle with respect to the horizontal. For example, in one embodiment, the normal to the surface of cam leading edge 862 may form a negative 45 degree angle with respect to the horizontal, while the normal to the surface of inner rim leading edge 872 may form a positive 45 degree angle with respect to the horizontal. Generally, the total displacement of actuator 6, i.e., the vertical displacement and angular rotation, may determine the dimensions of cam 860 and inner rim 870, such as, for example, a preferred incline angle for cam leading edge 862 and inner rim leading edge 872, a preferred height and length of cam 860 and inner rim 870, etc. Although both incline angles may be approximately equal, this is not necessarily required.

Further rotation causes cam leading edge 862 to slide along inner rim leading edge 872, thereby lowering actuator 6, and, more particularly, downwardly extending projection 899, onto the aerosol valve stem. The leading edge of downwardly extending projection 899 may be beveled to facilitate mating of the aerosol valve stem. In this manner, small axial misalignments between downwardly extending projection 899 and the aerosol valve stem may be accommodated; in other words, actuator 6 may be self-centering. Once actuator 6 is in the dispensing position, depression of actuator 6 seats downwardly extending projection 899 onto the aerosol valve stem and actuates the aerosol valve. In this embodiment, downwardly extending projection 899 does not engage the aerosol valve stem in the non-dispensing position. Consequently, optional retaining lip 847 may protrude from one or more locations of the top circumference of upstanding wall 803 to prevent accidental displacement of actuator 6 from within upstanding wall 803 during processing, transportation, etc. In another embodiment, downwardly extending projection 899 may partially engage the aerosol valve stem in the non-dispensing position, so that rotation of actuator 6, from the non-dispensing position to the dispensing position, rotates downwardly extending projection 899 with respect to the aerosol valve stem.

To return actuator 6 to the non-dispensing position, actuator 6 is rotated in the opposite direction causing cam leading edge 862 to slide along inner rim leading edge 872, thereby raising actuator 6. As actuator 6 is raised, downwardly extending projection 899 slides upwardly with respect to the aerosol valve stem. Once cam leading edge 862 clears inner rim leading edge 872, cam lower surface 864 may then slide along inner rim upper surface 874 until projecting edge 21 engages limit stop 22 and vertical wall 23. In the non-dispensing position, downwardly extending projection 899 may be completely disengaged from the aerosol valve stem. In another embodiment, downwardly extending projection 899 may engage the aerosol valve stem at least partially. In an embodiment, nozzle closure 840 may then be inserted into spray nozzle 9. In another embodiment, once safety tab 50 clears upstanding wall 803, projecting lip 52 engages vertical wall 54 of upstanding wall 803, under the influence of the outward bias of safety tab 50, to prevent rotation of actuator 6.

Several embodiments of the present invention are specifically illustrated and described herein. However, it will be appreciated that modifications and variations of the present invention are covered by the above teachings and within the purview of the appended claims without departing from the spirit and intended scope of the invention.

What is claimed is:

1. An attachment for an aerosol dispensing package, comprising: an actuator, having a dispensing position and a non-dispensing position, including:

an actuator body including:

a substantially cylindrical wall portion, a spray nozzle, a downwardly extending projection, in fluid communication with the spray nozzle, to sealingly engage an upwardly projecting stem of an aerosol valve when the actuator is in the dispensing position, and at least one cam formed at a lower edge of said wall portion and having sloped leading and trailing edges; and a mounting cap, including:

at least one inner rim having leading and trailing edges matched to those of said at least on cam arranged, said edges arranged to be engaged by the leading and trailing edges of said at least one cam to lower the actuator to the dispensing position and raise the actuator to the non-dispensing position changing the degree of engagement of said downwardly extending projection with said upwardly projecting stem, and an upstanding wall, at least partially surrounding the actuator wall portion, including:

a spray opening adjacent to the spray nozzle when the actuator is in the dispensing position.

2. The attachment of claim 1, further comprising:

a lateral opening in the upstanding wall adjacent to the spray nozzle when the actuator is in the non-dispensing position, and a nozzle closure, hingedly attached to the mounting cap, including:

a projection, fitting into the lateral opening and the spray nozzle, to seal the spray nozzle when the actuator is in the non-dispensing position.

3. The attachment of claim 1, wherein the downwardly extending projection is adapted to partially engage the upwardly projecting stem of the aerosol valve when the actuator is in the non-dispensing position.

4. The attachment of claim 1, wherein:

the cam includes a cam leading edge, the inner rim includes an inner rim leading edge, and the cam leading edge and the inner rim leading edge form equivalent complementary angles with respect to the horizontal.

5. The attachment of claim 4, wherein the cam leading edge forms a negative 45 degree angle with respect to the horizontal and the inner rim leading edge forms a positive 45 degree angle with respect to the horizontal.

6. The attachment of claim 4, wherein:

the actuator includes a first cam and a second cam, the first cam disposed approximately 180 degrees from the second cam along the bottom of the actuator, and the mounting cap includes a first inner rim and a second inner rim corresponding to the first cam and the second cam, respectively, the first inner rim disposed approximately 180 degrees from the second inner rim along the inner diameter of the mounting cap.

7. The attachment of claim 1, further comprising:

a hinged tab having a projecting lip on the actuator to abut a vertical wall of an anterior opening of the upstanding wall and prevent rotation of the actuator from the non-dispensing position unless the tab is pushed in so that the projecting lip clears the vertical wall while at the same time rotating the actuator to the dispensing position.

8. The attachment of claim 7, wherein the tab includes a lower part formed from a wall of the actuator and an upper part including the projecting lip.

9. The attachment of claim 8, wherein the tab is integrally molded with the actuator and separated from the actuator by an upper slit and two side slits so as to form a bottom hinge about which the tab may rotate.

10. The attachment of claim 1, further comprising:

a projecting edge on the actuator to overlie a limit stop of an anterior opening of the upstanding wall, the limit stop to prevent downward movement of the actuator when the actuator is in the non-dispensing position.

11. The attachment of claim 1, wherein the mounting cap is adapted to be press fit onto a rim of a mounting cup of an aerosol container, the mounting cup including the aerosol valve.

12. The attachment of claim 1, wherein the mounting cap is adapted to be snap fit onto a rim of a mounting cup of an aerosol container, the mounting cup including the aerosol valve.

13. The attachment of claim 1, wherein the downwardly extending projection terminates in a beveled male fitting.

14. The attachment of claim 1, wherein the downwardly extending projection terminates in a beveled female fitting.

15. The attachment of claim 1, further comprising:

at least one retaining lip, extending inwardly from the top of the upstanding wall and protruding over the top of the actuator, to limit the displacement of the actuator in the actuation direction.

16. An aerosol dispensing package, comprising:

an aerosol container having a mounting cup including an aerosol valve with an upwardly projecting stem, an actuator, having a dispensing position and a non-dispensing position, including:

a projecting edge, a spray nozzle, a downwardly extending projection, in fluid communication with the spray nozzle, to sealingly engage the upwardly projecting stem when the actuator is in the dispensing position, and at least one cam formed at a lower edge of said wall portion and having sloped leading and trailing edges;

a mounting cap, fitted to the mounting cup, including:

at least one inner rim having sloped leading and trailing edges matched to those of said at least on cam arranged, said edges arranged to be engaged by the leading and trailing edges of said at least one cam to lower the actuator to the dispensing position and raise the actuator to the non-dispensing position changing the degree of engagement of said downwardly extending projection with said upwardly projecting stem, and an upstanding wall, at least partially surrounding the actuator, including:

an anterior opening having a limit stop to engage the projecting edge and prevent downward movement of the actuator when the actuator is in the non-dispensing position, a lateral opening adjacent to the spray nozzle when the actuator is in the non-dispensing position, a spray opening adjacent to the spray nozzle when the actuator is in the dispensing position; and a nozzle closure, hingedly attached to the mounting cap, including:

a projection, fitting into the lateral opening and the spray nozzle, to seal the spray nozzle when the actuator is in the non-dispensing position.

17. The aerosol dispensing package of claim 16, wherein:

the actuator includes a first cam and a second cam, the first cam disposed approximately 180 degrees from the second cam along the bottom of the actuator, and the mounting cap includes a first inner rim and a second inner rim to engage the first cam and the second cam, respectively, the first inner rim disposed approximately 180 degrees from the second inner rim along the inner diameter of the mounting cap.

18. The aerosol dispensing package of claim 16, wherein:

the first cam includes a first cam leading edge and the second cam includes a second cam leading edge, the first inner rim includes a first inner rim leading edge and the second inner rim includes a second inner rim leading edge, the first cam leading edge and the first inner rim leading edge form equivalent complementary angles with respect to the horizontal, and the second cam leading edge and the second inner rim leading edge form equivalent complementary angles with respect to the horizontal.

19. The aerosol dispensing package of claim 18, wherein the first and second cam leading edges form negative 45 degree angles with respect to the horizontal and the first and second inner rim leading edges form positive 45 degree angles with respect to the horizontal.

20. The aerosol dispensing package of claim 16, further comprising:

a hinged tab having a projecting lip on the actuator to abut a vertical wall of an anterior opening of the upstanding wall and prevent rotation of the actuator from the non-dispensing position unless the tab is pushed in so that the projecting lip clears the vertical wall while at the same time rotating the actuator to the dispensing position.

21. The aerosol dispensing package of claim 20, wherein the tab includes a lower part formed from a wall of the actuator and an upper part including the projecting lip, the tab integrally molded with the actuator and separated from the actuator by an upper slit and two side slits so as to form a bottom hinge about which the tab may rotate.

22. The aerosol dispensing package of claim 16, wherein the downwardly extending projection terminates in a beveled male fitting.

23. The aerosol dispensing package of claim 16, wherein the downwardly extending projection terminates in a beveled female fitting.

24. The aerosol dispensing package of claim 16, further comprising: at least one retaining lip, extending inwardly from the top of the upstanding wall and protruding over the top of the actuator, to limit the displacement of the actuator in the axial direction.

25. An attachment for an aerosol dispensing package, comprising:

an actuator, having a dispensing position and a non-dispensing position, including:

a projecting edge, a spray nozzle, a downwardly extending projection, in fluid communication with the spray nozzle, to sealingly engage an upwardly projecting stem of an aerosol valve when the actuator is in the dispensing position, and a hinged tab having a projecting lip to prevent rotation of the actuator from the non-dispensing position unless the tab is pushed in while at the same time rotating the actuator to the dispensing position, at least one cam formed at a lower edge of said wall portion and having sloped leading and trailing edges;

a mounting cap, including:

a mounting cap, fitted to the mounting cup, including:

at least one inner rim having sloped leading and trailing edges matched to those of said at least on cam arranged, said edges arranged to be engaged by the leading and trailing edges of said at least one cam to lower the actuator to the dispensing position and raise the actuator to the non-dispensing position changing the degree of engagement of said downwardly extending projection with said upwardly projecting stem, and an upstanding wall, at least partially surrounding the actuator, including:

an anterior opening having a limit stop to engage the projecting edge and prevent downward movement of the actuator when the actuator is in the non-dispensing position, a lateral opening adjacent to the spray nozzle when the actuator is in the non-dispensing position, a spray opening adjacent to the spray nozzle when the actuator is in the dispensing position; and a nozzle closure, hingedly attached to the mounting cap, including:

a projection, fitting into the lateral opening and the spray nozzle, to seal the spray nozzle when the actuator is in the non-dispensing position.

26. The attachment of claim 1, further comprising:

a tamper evident tab removably attached to the upstanding wall and disposed within the spray opening.

27. The aerosol dispensing package of claim 16, further comprising:

a tamper evident tab removably attached to the upstanding wall and disposed within the spray opening.

28. The attachment of claim 25, further comprising:

a tamper evident tab removably attached to the upstanding wall and disposed within the spray opening.

* * * * *

UNITED STATES PATENT AND TRADEMARK OFFICE

CERTIFICATE OF CORRECTION

PATENT NO. : 6,971,552 B2
APPLICATION NO. : 10/754615
DATED : December 6, 2005
INVENTOR(S) : Meshberg It is certified that error appears in the above-identified patent and that said Letters Patent is hereby corrected as shown below:

| Column | Line | |
|---|---|---|
| 1 | 25 | Change **"a"** to **-- an --;** |
| 3 | 10 | Change **"a"** to **-- an --;** |
| 3 | 44 | Change **"remove"** to **-- removed --;** |
| 7 | 51 | Change **"well-methods"** to **-- methods --;** |
| 7 | 52 | Change **"attached"** to **-- attach --;** |
| 9 | 53 | Change **"at least on claim"** to **-- at least one claim --;** |
| 11 | 17 | Change **"at least on claim"** to **-- at least one claim --;** and |
| 12 | 49 | Change **"at least on claim"** to **-- at least one claim --.** |

Signed and Sealed this

Fifteenth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,971,552 B2
APPLICATION NO. : 10/754615
DATED : December 6, 2005
INVENTOR(S) : Meshberg It is certified that error appears in the above-identified patent and that said Letters Patent is hereby corrected as shown below:

Claim 1, line 16 (Column 9, line 53), “at least on cam” should read -- at least one cam --;

Claim 16, line 16 (Column 11, line 17), “at least on cam” should read -- at least one cam --; and Claim 25, line 20 (Column 12, line 49), “at least on cam” should read -- at least one cam --.

Signed and Sealed this

Eighth Day of April, 2008

JON W. DUDAS
*Director of the United States Patent and Trademark Office*